US009382601B2

(12) United States Patent
Lee

(10) Patent No.: US 9,382,601 B2
(45) Date of Patent: Jul. 5, 2016

(54) METHOD OF PRODUCING POROUS ALUMINUM

(71) Applicant: Hyundai Motor Company, Seoul (KR)

(72) Inventor: Jong Kook Lee, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 77 days.

(21) Appl. No.: 14/317,652

(22) Filed: Jun. 27, 2014

(65) Prior Publication Data

US 2015/0167119 A1 Jun. 18, 2015

(30) Foreign Application Priority Data

Dec. 13, 2013 (KR) ..... 10-2013-0155322

(51) Int. Cl.

| | |
|---|---|
| ***C22B 21/00*** | (2006.01) |
| ***C22B 21/06*** | (2006.01) |
| ***C22B 9/05*** | (2006.01) |
| ***C22C 49/06*** | (2006.01) |
| ***C22C 21/00*** | (2006.01) |
| ***C22C 1/08*** | (2006.01) |

(52) U.S. Cl.

CPC . *C22C 21/00* (2013.01); *C22B 9/05* (2013.01); *C22B 21/0084* (2013.01); *C22B 21/064* (2013.01); *C22C 1/08* (2013.01); *C22C 49/06* (2013.01); *B22F 2999/00* (2013.01); *C22C 2001/086* (2013.01)

(58) Field of Classification Search

CPC .. C22B 21/0084; C22B 21/064; C22B 9/035; C22B 9/05; C22C 49/06; C22C 21/00; C22C 27/08

See application file for complete search history.

(56) References Cited

FOREIGN PATENT DOCUMENTS

| | | | | |
|---|---|---|---|---|
| JP | 2004322143 | A | | 11/2004 |
| JP | 2010-280951 | A | | 12/2010 |
| KR | 10-2002-0028209 | | | 4/2002 |
| KR | 10-2005-0121332 | A | | 12/2005 |
| KR | 10-2012-0037399 | | | 4/2012 |
| KR | 10-2012-0136914 | | | 12/2012 |
| KR | 10-2013-0052208 | | | 5/2013 |
| KR | 10-2013-0092406 | A | | 8/2013 |
| KR | 20130106894 | A | * | 9/2013 |
| KR | 10-2013-0139318 | A | | 12/2013 |

OTHER PUBLICATIONS

Lee Seong Kyun. KR 20130106894 A. Machine translation of the description published Sep. 30, 2013.*

Esai, A., and K. Morsi. "Dispersion of Carbon Nanotubes (CNTs) in Aluminum Powder." ScienceDirect. Elsevier, vol. 38 (2007) pp. 646-350. Web. Nov. 4, 2015.*

KR 20130106894 A, "Aluminum Foam Containing CNT Graphene", published Sep. 2013. Human translation.*

* cited by examiner

*Primary Examiner* — George Wyszomierski
*Assistant Examiner* — Tima M McGuthry Banks
(74) *Attorney, Agent, or Firm* — Mintz Levin Cohn Ferris Glovsky and Popeo, P.C.; Peter F. Corless

(57) ABSTRACT

A method of producing a porous aluminum is provided. The method includes preparing a powder mixture of at least one of Al and an Al alloy and carbon nanoparticles and melting the powder mixture. In addition, the method includes oxidizing the melt using oxygen bubbling and solidifying the melt.

15 Claims, 1 Drawing Sheet

METHOD OF PRODUCING POROUS ALUMINUM

CROSS REFERENCE TO RELATED APPLICATION

This application claims the benefit of Korean Patent Application No. 10-2013-0155322, filed on Dec. 13, 2013, entitled "Method for producing porous aluminum," which is hereby incorporated by reference in its entirety into this application.

TECHNICAL FIELD

The present invention relates to a method of producing a porous aluminum (Al) as an ultralight Al material for reducing a weight of structural materials and collision members of a vehicle.

BACKGROUND

An aluminum foil has been used as a cathode collector for lithium ion batteries or electrical double-layer capacitors. Recently, since these batteries or capacitors have been diversely applied to such batteries or capacitors of electric vehicles or the like, high power and high energy density of electrode collectors in the batteries or capacitors are required. For example, an aluminum porous body having open pores with a three-dimensional mesh structure has been developed for the use of an electrode collector.

To manufacture such an aluminum porous body, for example, a foam melting method is known. In the foam melting method, molten aluminum is thickened by the addition of a thickener, and then added with titanium hydride of a foaming agent, to solidify the molten aluminum while being foamed using hydrogen gas produced through thermal decomposition reaction of titanium hydride. However, the foamed aluminum obtained by this method has a substantial amount closed pores with a size of ones of micrometers.

In another example, a method of producing foamed aluminum with a sponge backbone has been developed, and the method includes indenting aluminum in a template using sponge urethane as a core, and charging aluminum into hollow spaces formed by destruction of urethane via fire. According to this method, the foamed aluminum has open pores with a pore diameter of 40 PPI (cells per inch) or less and with a pore diameter of about 600 μm or more.

Another method of producing foamed aluminum has been developed in which foamed aluminum thereof has closed pores with a diameter of about 500 μm or less depending on the dimension of a reinforcing member. Further, the foamed aluminum thereof is produced by pressure permeating an aluminum alloy into the reinforcing member made of hollow ceramic.

In addition, a method of producing foamed aluminum has developed that includes placing a powder mixture of Al—Si alloy powder and titanium hydride ($TiH_2$) powder in an aluminum plate and then performing hot rolling, thus foaming aluminum by decomposition of $TiH_2$ powder. The foamed aluminum obtained by this method has a pore diameter as large as ones of micrometers.

In further examples, a method of producing foamed aluminum includes mixing aluminum with a metal having a eutectic temperature which is lower than the melting point of aluminum, and burning the mixture at a temperature greater than the eutectic temperature and lower than the melting point of aluminum. Although the foamed aluminum obtained by this method has a substantially small pore diameter, its porosity is as low as about 40%. Accordingly, the amount of cathode active material or anode active material which permeates the pores of the foamed aluminum as used as the collector is substantially low, thereby making it difficult to achieve desired high power and high energy density. The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention provides technical solutions to above-described problems encountered in the related art. Particularly, the present invention provides a method of producing a porous aluminum as an ultralight Al material for reducing the weight of vehicle structural materials and collision members.

In one exemplary embodiment of the present invention, a method of producing a porous aluminum may include: preparing a powder mixture of at least one of Al and Al alloy and carbon nanoparticles; melting the powder mixture; oxidizing the melt using oxygen bubbling; and solidifying the melt.

In addition, in preparing the powder mixture, at least one of Al and Al alloy in a powder phase may be mixed with the carbon nanoparticles. In preparing the powder mixture, the powder mixture may be compacted in a pellet form. The Al or Al alloy powder may have a diameter of about 1000 μm or less. In preparing the mixture, the powder mixture may have a particle size of about 200 μm or less. In other exemplary embodiments, in melting the powder mixture, the powder mixture may be melted together with an Al ingot. In melting the powder mixture, the powder mixture may be melted together with calcium (Ca). Ca may be used in an amount of about 1 to 2 wt %. In addition, melting the powder mixture may be performed at about 600 to 1100° Cand oxidizing may be performed by stirring the melt while performing oxygen ($O_2$) gas bubbling.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Figure 1:
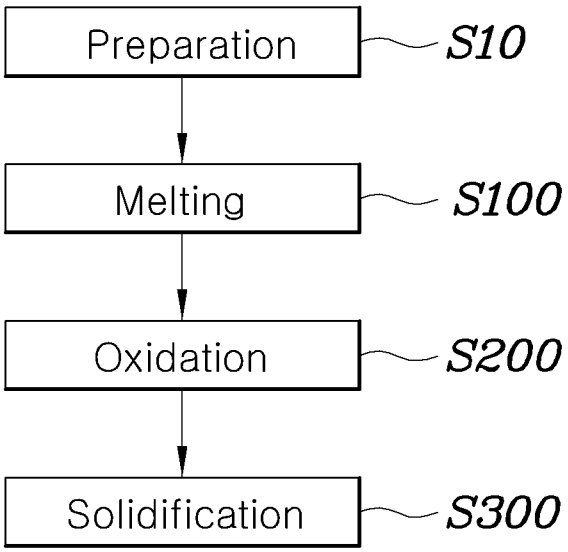
FIG. 1 shows an exemplary flowchart illustrating a process of producing porous aluminum according to one exemplary embodiment of the present invention.

Hereinafter, a detailed description will be given of a method of producing porous aluminum according to exemplary embodiments of the present invention with reference to the appended drawings. FIG. 1 shows an exemplary flowchart illustrating a process of producing porous aluminum according to one exemplary embodiment of the present invention. In one exemplary embodiment, the method of producing porous aluminum may include: preparing a powder mixture of at least one of Al and Al alloy and carbon nanoparticles (S10); melting the powder mixture (S100); oxidizing the melt using oxygen bubbling (S200); and solidifying the melt (S300).

In particular, in S10, at least one of Al and Al alloy in a powder phase may be mixed with carbon nanoparticles. Alternatively, the powder mixture may be compacted and provided in the form of a pellet. The Al or Al alloy powder may have a diameter of about 1000 μm or less. In S10, the powder mixture may have a particle size of about 200 μm or less. In S100, the powder mixture may be melted together with an Al ingot. Additionally, in S100, the powder mixture may be melted together with Ca and Ca may be used in an amount of about 1 to 2 wt %. S100 may be performed at about 600 to 1100° C. In S200, the melt may be stirred at the same time of oxygen gas bubbling.

In yet another exemplary embodiment of the present invention, the powder mixture of Al with the carbon nanoparticles including, without limitation, carbon nanotube (CNT), carbon nanofiber (CNF), graphine, graphite, and the like, may be prepared using Al powder. In particular, the powder mixture unchanged or in a pellet form obtained by compacting the powder mixture may be melted together with the Al ingot and Ca of about 1 to 2 wt % at about 600 to 1100° C., and $O_2$ gas bubbling and stirring may be conducted in the melt. Thereafter, nano-sized gas bubbles, such as carbon monoxide (CO) or carbon dioxide ($CO_2$), may be generated through the reaction of the carbon nanoparticles and $O_2$ gas in the melt, followed by solidification, thereby manufacturing a porous body.

The porous aluminum body obtained according to one exemplary embodiment of the present invention may have smaller nano-sized pores compared to porous aluminum bodies obtained by conventional methods, for example, ALPORAS, ALULIGHT methods, and the like which use hydrogen ($H_2$) gas. Therefore, the manufactured porous aluminum material in the present invention may have higher porosity and more uniform properties and may be lighter in weight by about 90% or more than existing Al materials and further may have a density of about 2.7

In particular, the method may include steps described below.

1) Al or Al alloy powder and carbon nanoparticles of about 1 to 10 wt % may be substantially uniformly mixed. When pure Al or Al alloy powder has a particle size greater than about 1000 μm, the average distance between CNTs mixed with such Al may become extended, thereby making it difficult to obtain substantially uniform pores. Therefore, the powder may have a diameter of about 1000 μm or less.

In particular, single- or multi-walled CNTs may be used. In mixing of Al powder and CNTs, energy has to be sufficiently applied to the extent that the surface of CNTs is mechanically damaged. The milling at 190 RPM at minimum for 10 hr or longer may be required or when RPM varies, the milling time may be adjusted to supply energy equal to or greater than the standard. Furthermore, since CNTs may not be mechanically damaged by mixing using milling for a longer period of time at about 100 RPM or less, the milling rate may be at least 100 RPM or more. 2) In some exemplary embodiments, the unchanged powder mixture or the powder mixture compacted in the form of a pellet may be used in the subsequent processes. The powder mixture may be used in the form of pellet after compacting when the particle size of Al-CNT powder mixture is less than about 200 μm. When the particle size of the powder mixture is equal to or greater than about 200 μm, the powder mixture in the Al melt may float upwards or may react with $O_2$ gas in the atmosphere and thus may be combusted.

3) In a crucible made of graphite or metal, the powder mixture or the pellet thereof, the pure Al or Al Alloy ingot, and Ca as of a viscosity control element which is capable of controlling the viscosity of the melt may be placed together, and subsequently heated to about 600° C. or greater until the placed materials and elements are completely melted. Depending on the amount of CNTs in the final material, the relative density of the final material may vary. When less amount of the CNTs is used, the relative density may increase. On the other hand, when more amount of the CNTs is used, the relative density may decrease. However, when the amount of CNTs increases, it may be difficult to control pore uniformity in the final material. Therefore, the upper limit of the amount of CNTs may be about 10 vol % or less. In addition, the amount of Ca which is a viscosity control element may be about 1 to 2 wt %. When the amount of Ca as the viscosity control element is less than about 1 wt %, the pores formed in the melt may float upwards and thus the pore density in the melt may decrease. In contrast, when the amount thereof exceeds 2 wt %, the viscosity of the melt may increase, thus suppressing the formation of pores.

4) Furthermore, $O_2$ gas may be blown into the melted material at a temperature of about 600° C. or greater. Since $O_2$ gas floats upwards inside the melt, blowing may be performed at the bottom of the melt, and the blown $O_2$ gas reacts with CNTs while floating upwards, thereby generating CO or $CO_2$ gas. In addition, since the blown $O_2$ gas may have a substantially large gas bubble size, the blown $O_2$ gas may easily float upwards in the melt; but CO or $CO_2$ gas resulting from reaction with CNTs may have a substantially small bubble size, thereby making it difficult to float in the viscous melt.

The chemical reaction thereof in the melt is presented below.

$$C(\text{in CNTs})+O_2(\text{gas})CO(\text{gas}) \text{ or } CO_2(\text{gas})$$

The diameter of the CNTs alone may be in the range from ones to tens of nanometers, and the length thereof may be also less than ones of micrometers, and thus CO or $CO_2$ gas bubbles produced through the above chemical reaction may have a size ranging from ones to tens of micrometers.

5) After completion of the chemical reaction, the melt may be solidified when it is in the crucible or is placed in a mold having a desired shape. The solidified material may have pores which have a size ranging from ones to tens of micrometers and are substantially uniformly distributed therein, and the relative density thereof is less than about 1/10 of at maximum compared to typical Al having about the same volume. Therefore, the specific strength and the specific stiffness are greater ones to tens fold. When this material is applied to a front side member or a bumper back beam for a vehicle, collision energy absorption capability may be drastically enhanced.

Figure 2:
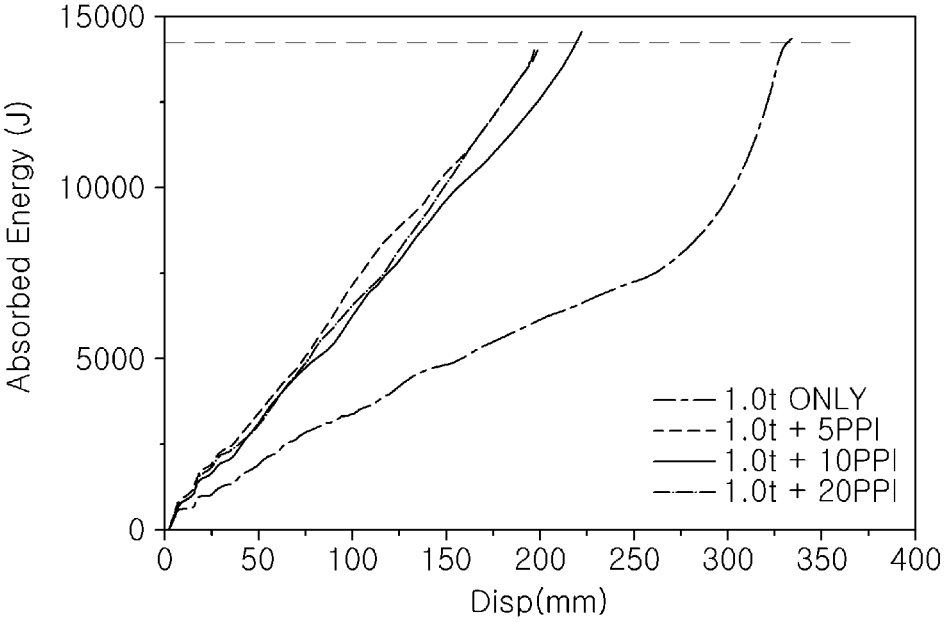
FIG. 2 shows an exemplary graph illustrating the extent of deformation upon collision of various aluminum materials produced by the process according to one exemplary embodiment of the present invention.

FIG. 2 is an exemplary graph illustrating the extent of deformation upon collision of various aluminum materials produced by the process according to one exemplary embodiment of the present invention, of which the displacement is improved by about 66% at maximum based on the same collision energy absorption at 14000 J. Therefore, according to the method of producing porous aluminum having the above structure in the present invention, an ultralight Al material for reducing the weight of vehicle structural materials and collision members may be provided.

As described hereinbefore, the present invention provides a method of producing a porous aluminum. According to the present invention, the porous aluminum may be developed as an ultralight Al material for achieving lightness of vehicle structural materials and collision members. Although the exemplary embodiment of the present invention depicted in the drawings has been disclosed for illustrative purposes, those skilled in the art will appreciate that various modifications, additions and substitutions are possible, without departing from the scope and spirit of the invention as disclosed in the accompanying claims.

What is claimed is:

1. A method of producing porous aluminum, comprising:

preparing a powder mixture of at least one of aluminum (Al) and Al alloy and carbon nanoparticles, wherein in preparing the powder mixture, the powder mixture is compacted in a pellet form;

melting the powder mixture to obtain a melt;

oxidizing the melt using oxygen bubbling; and solidifying the melt.

2. The method of claim 1, wherein in preparing the powder mixture, at least one of Al and Al alloy in a powder phase is mixed with the carbon nanoparticles.

3. The method of claim 2, wherein the Al or Al alloy powder has a diameter of about 1000 μm or less.

4. The method of claim 1, wherein in preparing the powder mixture, the powder mixture has a particle size of about 200 μm or less.

5. The method of claim 1, wherein in melting the mixture, the powder mixture is melted together with an Al ingot.

6. The method of claim 1, wherein in melting the mixture, the powder mixture is melted together with calcium (Ca).

7. The method of claim 6, wherein the Ca is used in an amount of about 1 to 2 wt %.

8. The method of claim 1, wherein the melting the powder mixture is performed at about 600 to 1100° C.

9. The method of claim 1, wherein the oxidizing is performed by stirring the melt while performing oxygen bubbling.

10. A method of producing porous aluminum, comprising:

preparing a powder mixture of at least one of aluminum (Al) and Al alloy and carbon nanoparticles;

melting the powder mixture together with an Al ingot to obtain a melt;

oxidizing the melt using oxygen bubbling; and solidifying the melt.

11. The method of claim 10 wherein in preparing the powder mixture, at least one of Al and Al alloy in a powder phase is mixed with the carbon nanoparticles.

12. The method of claim 11 wherein the Al or Al alloy powder has a diameter of about 1000 μm or less.

13. The method of claim 10 wherein in preparing the powder mixture, the powder mixture has a particle size of about 200 μm or less.

14. The method of claim 10 wherein the melting the powder mixture is performed at about 600 to 1100° C.

15. The method of claim 10, wherein the oxidizing is performed by stirring the melt while performing oxygen bubbling.

* * * * *